United States Patent [19]

Currey

[11] Patent Number: 5,021,016

[45] Date of Patent: Jun. 4, 1991

[54] OUTBOARD MOTOR SUPPORT

[76] Inventor: Lesley B. Currey, 122 Park St., Monticello, Ark. 71655

[21] Appl. No.: 487,847

[22] Filed: Mar. 5, 1990

[51] Int. Cl.[5] ..... B60P 3/10

[52] U.S. Cl. ..... 440/113; 248/640; 280/414.1; 440/900

[58] Field of Search ..... 440/53, 63, 113, 900; 248/640, 641, 642, 643; 188/129, 300; 267/33; 280/414.1

[56] References Cited

U.S. PATENT DOCUMENTS

| | | | |
|---|---|---|---|
| 4,125,236 | 11/1978 | Landwerlen | 248/640 |
| 4,438,908 | 3/1984 | Terada | 267/33 |
| 4,650,427 | 3/1987 | Huchinson | 248/642 |
| 4,685,888 | 8/1987 | Brewer | 440/53 |

*Primary Examiner*—Sherman D. Basinger
*Assistant Examiner*—Thomas J. Brahan
*Attorney, Agent, or Firm*—John M. Harrison

[57] ABSTRACT

An outboard motor support for supporting and cushioning the lower unit of an outboard motor when the boat carrying the outboard motor is being trailered. The outboard motor support is characterized by an elongated, tubular outside support fitted with a V-shaped foot-engaging member at one end for engaging the foot of the outboard motor and a telescoping support at the opposite end, which telescoping support terminates in a yoke for adjustably engaging the frame of the trailer. The telescoping support is spring-loaded in the outside support and a rubber shock absorber is provided in the outside support near the foot-engaging member, in order to cushion the outboard motor foot against road shock.

10 Claims, 1 Drawing Sheet

OUTBOARD MOTOR SUPPORT

BACKGROUND OF THE INVENTION

1. Field of the Invention

This invention relates to supports for outboard motors while trailering boats upon which the outboard motors are mounted and more particularly, to an outboard motor support provided with a built-in shock absorbing function and an adjustment function. In a preferred embodiment the outboard motor support of this invention is characterized by an elongated, tubular outside support provided with a V-shaped foot-engaging member at one end, a rubber shock absorber located in the outside support, a telescoping support having one end mounted in telescoping fashion in the outside support, with a spring provided between the telescoping support and the shock absorber and further including a frame-engaging yoke located at the opposite extending end of the telescoping support. The outboard motor support is positioned in functional configuration with the yoke engaging a transverse trailer frame member and the V-shaped foot-engaging member engaging the foot portion of the outboard motor for cushioning the outboard motor against road shock during travel. The spring located inside the outside support and positioned between the enclosed end of the telescoping support and the shock absorber facilitates initially positioning the outboard motor support between the foot of the motor and the transverse frame member, wherein the shock absorbing function is achieved by the rubber shock absorber during trailering of the boat and motor.

One of the problems which is realized in the trailering of outboard motors and boats and heavy outboard motors in particular, is the risk of damaging the motor due to road shock. Outboard motors are mounted on the transom at the rear of a boat and considerable pressure and torque is exerted on the transom during trailering due to the weight of the motor. This torque frequently causes damage to the transom and can weaken the transom, such that operation of the boat in a normal manner is rendered dangerous.

2. Description of the Prior Art

Various types of support devices have been developed for supporting the foot portion of an outboard motor on the transom of a boat during trailering. These supports range from a simple yoke device which telescopes and is adjustable by means of a pin in spaced openings, to more sophisticated devices such as the support detailed in U.S. Pat. No. 4,828,186, dated May 9, 1989, entitled "Boat Motor Support", to Gordon E. Weiss. The support is adapted to provide adjustable absorption of impact loads against either the trailer or the overhung motor itself, and includes a trailer frame mount bracket at one end and a motor mount bracket at the other end, with telescoping members which may be relatively adjusted to shorten or lengthen the support. Multiple elastic members are disposed within the telescoping members to cushion the longitudinal movement thereof. The number, size and elasticity of the cushion members can be varied to alter the shock absorption properties of the support. U.S. Pat. No. 4,650,427, dated Mar. 17, 1987, to Same E. Hutchinson, details a "Spring-Action Boat Motor Support". The boat motor support is adjustable and may be attached to the boat transom or trailer and motor to prevent damage to the boat transom during transportation. The device includes a vertically expandable first assembly pivotally mounted at one end to the boat transom and having a seat member at the opposite end, in which the lower motor housing can rest. A motor attachment assembly is vertically and adjustably attached at one end to the first assembly and may be attached at its opposite end to the lower motor housing. An "Outboard Motor Support" is detailed in U.S. Pat. No. 4,685,888, dated Aug. 11, 1987, to Frank Brewer. The device includes a shock arm adapted to be mounted between a trailer and the shaft of an outboard motor attached to a boat carried by the trailer. The shock arm includes a lower member rigidly attached to the trailer frame and an upper member having a V-shaped portion and adapted to receive the motor shaft. Between the lower and upper ends is a shock absorber which absorbs the shock of the motor whenever the trailer hits a bump in the road. A hydril electric tilt mechanism may be provided as a part of the motor to return the compressed shock absorber to the normal position, or a spring may be included with the shock absorber to cause it to return to the normal position. U.S. Pat. No. 3,693,536, dated Sept. 26, 1972, to James A. Driscoll, details an "Outboard Motor Stabilizer". The stabilizer includes a first forked end for embracing the front side of the lower end of the upstanding propeller shaft housing of an outboard motor and a strap for releasably securing the propeller shaft housing in the first forked end of the propeller. The second end of the propeller has a mounting bracket for swinging the propeller relative to the mounting bracket about an axis extending transversely of the second end of the propeller. The mounting bracket is in turn supported from a mounting plate for swinging about an axis relative to the mounting plate disposed at right angles to the first mentioned axis and the mounting plate is provided with means for securing the device to the transverse cross member of a trailer frame. U.S. Pat. No. 3,941,344, dated Mar. 2, 1976, to Albert E. Paterson, details another motor support. The motor support includes a substantially U-shaped yoke, a pedestal fastened to the base portion of the yoke, a retaining strap which engages rings located in the yoke and a swivel coupling which is mounted on the end opposite the yoke and which is engagable with a swivel mounted on the rearward terminal of a typical trailer frame. U.S. Pat. No. 4,842,239, dated June 27, 1989, to Darrell Kinsey, details an "Outboard Boat Motor Support" which includes an elongated support shaft that is adjustable in length, a U-shaped foot connected to one end of the support shaft and a transverse engagement rod and bracket connected to the opposite end of the support shaft. The support device is designed for disposition between the outboard motor and the boat trailer, with the U-shaped foot in engagement with the trailer and the transverse rod and bracket in engagement with the mounting bracket through which the outboard motor is pivotally interconnected to the transom of the boat.

It is an object to provide a new and improved outboard motor support which is characterized by a spring-loaded, adjustable function and having a foot-engaging member at one end for engaging the outboard motor foot and a yoke at the opposite end for engaging the trailer frame.

Another object of this invention is to provide an outboard motor support for supporting and cushioning the lower unit of an outboard motor during trailering, which outboard motor support includes an elongated, tubular outside support fitted with a V-shaped foot-engaging member at one end for engaging the foot of the outboard motor and a spring-loaded, telescoping support at the opposite end, which telescoping support terminates in a yoke for adjustably engaging the transverse frame of the trailer.

Another object of this invention is to provide an outboard motor support for engaging, supporting and cushioning the lower unit or foot of an outboard motor during trailering, which outboard motor support includes an elongated, telescoping support member fitted with a V-shaped foot-engaging member at one end and a telescoping yoke at the opposite end, which support member is provided with an internal shock absorber and coil spring for receiving the telescoping yoke and adjustably positioning the support between the outboard motor foot and the trailer frame and cushioning the outboard motor foot against road shock during trailering.

SUMMARY OF THE INVENTION

These and other objects of the invention are provided in an outboard motor support for engaging, supporting and cushioning the lower unit of an outboard motor against road shock during trailering, which outboard motor support is characterized by an elongated tubular outside support fitted with an adjustable V-shaped foot-engaging member and an internal shock absorber at one end for engaging and cushioning the foot of the outboard motor and an elongated tubular telescoping member at the opposite end, which telescoping member terminates in a yoke and is spring-loaded in the outside support for adjustably fitting between the foot of the outboard motor and cushioning the outboard motor foot during trailering.

BRIEF DESCRIPTION OF THE DRAWING

The invention will be better understood by reference to the accompanying drawing wherein.

DESCRIPTION OF THE PREFERRED EMBODIMENTS

Figure 1:
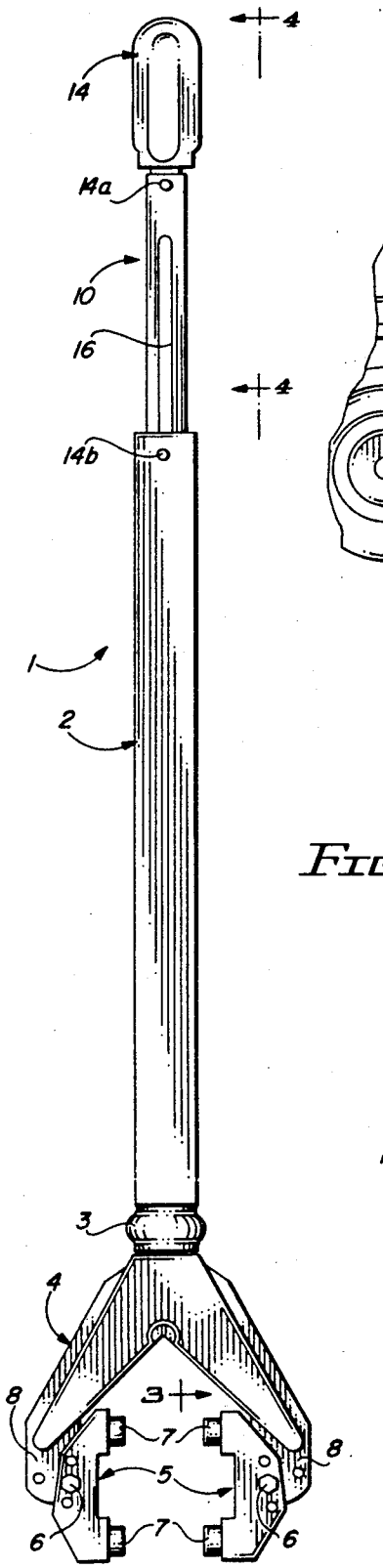
FIG. 1 is a top view of a preferred embodiment of the outboard motor support of this invention.
Figure 2:
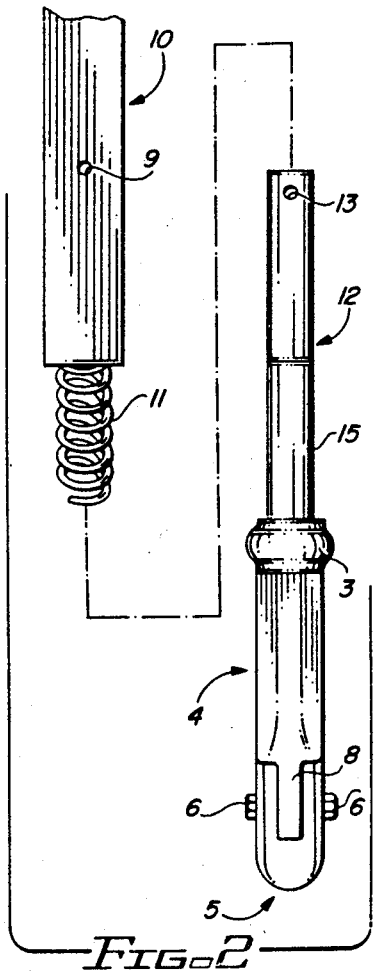
FIG. 2 is an exploded view of the shock absorber end of the outboard motor support illustrated in FIG. 1.

Referring initially to FIGS. 1–4 of the drawing the outboard motor support of this invention is generally illustrated by reference numeral 1 and includes an elongated, tubular outside support 2 having a V-shaped foot-engaging member 4 attached to one end and receiving an elongated, telescoping support 10 at the opposite end. A flexible seal or cuff 3 is provided on the foot-engaging bar 15, attached to the foot engaging member 4, for sealing the interface between the end of the outside support 2 and the foot-engaging member 4 when the foot-engaging bar 15 is inserted in the open end of the outside support 2, as illustrated in FIGS. 1 and 2. A coil spring 11 is inserted in the end of the outside support 2 which receives the foot-engaging bar 15 and a resilient shock absorber 12 is fitted to the end of the foot engaging bar 15, as further illustrated in FIG. 2. Accordingly, as illustrated in FIGS. 1 and 2, it will be appreciated that the foot-engaging bar 15 and the resilient shock absorber 12 may be inserted in the end of the outside support 2 when the outboard motor support 1 is assembled as illustrated in FIG. 1. An outside support pin opening 9 is provided in the outside support 2 and a matching shock absorber pin opening 13 is provided in the extending end of the resilient shock absorber 12, for receiving an assembly pin (not illustrated) and securing the foot-engaging bar 15 inside the outside support 2 and the V-shaped foot engaging member 4 on one end of the outside support 2, as further illustrated in FIG. 1. It will be further appreciated from a consideration of FIG. 1 that the telescoping support 10 is provided with a longitudinal telescoping support slot 16 and is slidably fitted inside the outside support 2 against the bias of the coil spring 11, to facilitate quick and easy insertion of the outboard motor support 1 between the motor foot 18 of an outboard motor 17 and the trailer frame 21 of a boat trailer 20 as further illustrated in FIG. 5. A slot pin **14*b* extends transversely through the outside support 2 and the telescoping support slot 16 to allow the telescoping support 10 to telescope against the bias of the coil spring 11 throughout the length of the telescoping support slot 16, without exiting the end of the outside support 2. A U-shaped frame-engaging yoke 14 is attached to the extending end of the telescoping support 10 by means of a yoke pin 14*a*. When the outboard motor support 1 is to be positioned between the motor foot 18 and the boat trailer 20, the coil spring 11 is partially compressed, the outboard motor support inserted in position and the outboard motor 17 is lowered to further compress the coil spring 11 until the telescoping end of the telescoping support 10 is fitted tightly against the compressed coils of the coil spring 11, to facilitate operation of the shock absorbing function presented by the resilient shock absorber 12. Accordingly, when the outboard motor 17 tends to pivot downwardly at random and exert torque on the transom (not illustrated) of the boat 19 due to road shock while trailering, the resilient shock absorber 12 compresses to absorb the road shock and prevent damage to the motor foot 18, outboard motor 17 or the transom of the boat 19**.

Figure 5:
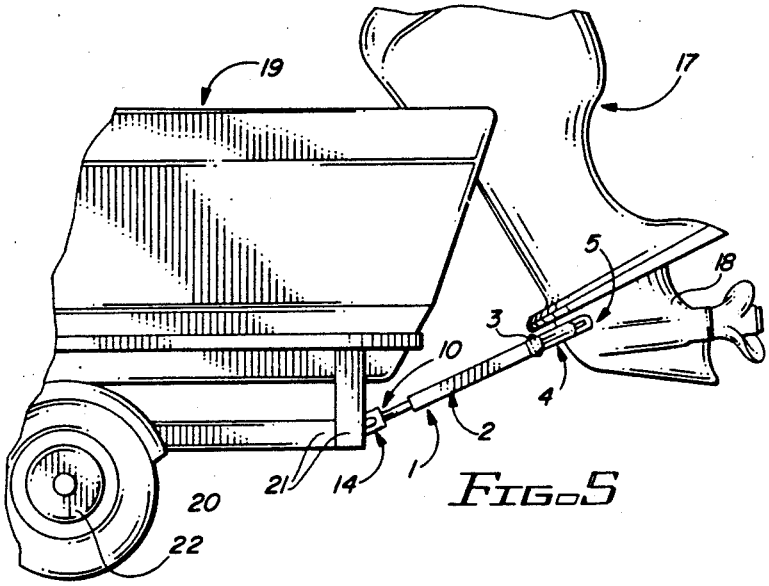
FIG. 5 is a side view, partially in section, of the outboard motor support inserted between the trailer frame and the foot of an outboard motor in functional, shock absorbing configuration.
Figure 3:
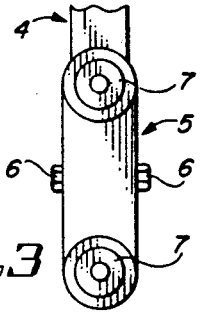
FIG. 3 is an end view of an engaging arm element of the shock absorber end of the outboard motor support illustrated in FIG. 1.
Figure 4:
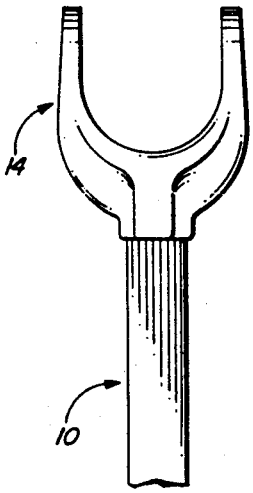
FIG. 4 is a side view of the yoke end of the outboard motor support illustrated in FIG. 1.

Referring again to FIGS. 1 and 2 of the drawings, in a most preferred embodiment of the invention the V-shaped foot-engaging member 4 includes a pair of engaging arms 5, which are pivotally attached to corresponding arm brackets 8, fixed to the foot engaging member 4, by means of pivot bolts 6. Cushion tabs 7 extend from spaced faces of the engaging arms 5, in order to engage the motor foot 18 of the outboard motor 17 as illustrated in FIG. 5.

It will be appreciated by those skilled in the art that the outboard motor support of this invention is versatile, in that it can be adjustably secured between an outboard motor 17 and a boat trailer 20 at substantially any angle of tilt of the outboard motor 17 with respect to the transom of the boat 19. This versatility is facilitated by operation of the telescoping support slot 16 and the coil spring 11, which together allow up to about one foot of travel between the telescoping support 10 and the outside support 2. Moreover, while the resilient shock absorber 12 is most preferably constructed of a rubber cylinder about three inches in length, it will be appreciated by those skilled in the art that a shock absorber of any desired length, as well as any desired rubber composition may be utilized, depending upon the weight of the outboard motor 17. Furthermore, while the outside support 2 and telescoping support 10 of the outboard motor support 1 is illustrated as constructed of square box tubing it will be further appreciated that round tubing may also be utilized, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An outboard motor support for supporting an outboard motor from a trailer, comprising a first support member having a V-shaped foot-engaging member and a foot-engaging bar carried by said foot-engaging member for attachment to said first support member at one end for engaging the outboard motor; a rubber cylinder carried by said first support member; a second support member having trailer-engaging means provided on one end thereof, said second support member slidably carried by said first support member; a flexible cuff provided on said foot-engaging bar at said first support member for sealing the interface between said foot-engaging bar and said first support member; and a coil spring carried by said first support member between said rubber cylinder and said second support member, whereby said first support member and said second support member are positioned between the outboard motor and the trailer with said motor-engaging means engaging the motor and said trailer-engaging means engaging the trailer, responsive to sliding of said second support member with respect to said first support member against the bias of said coil spring and compressing said coil spring against said resilient shock absorbing means.

2. The outboard motor support of claim 1 wherein:

(a) said motor-engaging member further comprises a V-shaped foot-engaging member and a foot-engaging bar carried by said foot-engaging member for insertion in said first support member; and (b) said shock absorbing means further comprises a rubber cylinder extending longitudinally from said foot-engaging bar.

3. The outboard motor support of claim 1 wherein said trailer-engaging means further comprises a U-shaped yoke for removably engaging the trailer.

4. The outboard motor support of claim 1 wherein said second support member telescopes in said first support member and further comprising a longitudinal slot provided in said second support member and a slot pin extending transversely through said first support member and said longitudinal slot, for slidably mounting said second support member in said first support member in telescoping relationship.

5. The outboard motor support of claim 4 wherein said trailer-engaging means further comprises a U-shaped yoke for removably engaging the trailer.

6. An outboard motor support for adjustably and removably supporting an outboard motor in tilted configuration with respect to a trailer, said outboard motor support comprising a first elongated tubular support member having a motor-engaging element at one end for engaging the outboard motor; resilient shock absorbing means provided in said first elongated tubular support member; a second elongated tubular support member having a trailer-engaging element provided on one end thereof and the opposite end of said second elongated tubular support member provided in slidable, telescoping relationship in the opposite end of said first elongated tubular support member; and a coil spring provided in said first elongated tubular support member between said shock absorbing means and said opposite end of said second elongated tubular support member, whereby said first elongated tubular support member and said second elongated tubular support member are positioned between the outboard motor and the trailer in shock absorbing relationship, with said motor-engaging element engaging the motor and said trailer-engaging element engaging the trailer, responsive to telescoping of said second elongated tubular support member in said first elongated tubular support member against the bias of said coil spring and compressing said coil spring against said resilient shock absorbing means.

7. The outboard motor support of claim 6 wherein:

(a) said motor-engaging element further comprises a V-shaped foot-engaging member and a foot-engaging bar carried by said foot-engaging member for insertion in said one end of said first elongated tubular support member; and (b) said trailer-engaging element further comprises a U-shaped yoke for removably engaging the trailer.

8. The outboard motor support of claim 6 further comprising a flexible cuff provided on said foot-engaging bar at said one end of said first elongated tubular support member for sealing the interface between said foot-engaging bar and said first elongated tubular support member.

9. The outboard motor support of claim 6 wherein said shock absorber means further comprises a rubber cylinder and further comprising a longitudinal slot provided in said second elongated tubular support member and a slot pin extending transversely through said opposite end of said first elongated tubular support member and said longitudinal slot, for slidably mounting said second elongated tubular support member in said opposite end of said first elongated tubular support member in telescoping relationship.

10. The outboard motor support of claim 9 further comprising a flexible cuff provided on said foot-engaging bar at said one end of said first elongated tubular support member for sealing the interface between said foot-engaging bar and said first elongated tubular support member, and wherein:

(a) said motor-engaging element further comprises a V-shaped foot-engaging member and a foot-engaging bar carried by said foot-engaging member for insertion in said first elongated tubular support member; and (b) said trailer-engaging element further comprises a U-shaped yoke for removably engaging the trailer.

* * * * *